United States Patent [19]

Diesner

[11] 4,027,703

[45] June 7, 1977

[54] SHUTTLELESS WEAVING MACHINE, ESPECIALLY RIBBON LOOM

[75] Inventor: Ferdinand Diesner, Murg, Hanner, Baden, Germany

[73] Assignee: Jakob Muller, Forschungs-und Finanz AG, Frick, Switzerland

[22] Filed: Oct. 16, 1975

[21] Appl. No.: 623,074

[30] Foreign Application Priority Data

Oct. 16, 1974 Switzerland ..... 13884/74

[52] U.S. Cl. ..... 139/431; 139/22; 139/117; 139/432

[51] Int. Cl.[2] ..... D03D 47/42

[58] Field of Search ..... 139/122 R, 122 H, 123, 139/124 R, 124 A, 116, 22, 117, 431, 432

[56] References Cited

UNITED STATES PATENTS

| | | | |
|---|---|---|---|
| 2,208,886 | 7/1940 | Vorck | 139/124 |
| 2,758,614 | 8/1956 | Silberman et al. | 139/432 |
| 3,434,506 | 3/1969 | Muller | 139/124 |
| 3,674,058 | 7/1972 | Sellers et al. | 139/124 |

*Primary Examiner*—Henry S. Jaudon

[57] ABSTRACT

A shuttleless weaving machine, especially a ribbon loom, comprising at least one filling thread-insertion element and at least one to-and-fro driven knitting needle moving along the selvage or cloth edge which is situated opposite the filling thread-insertion element for the formation of a knitted edge by tying the inserted filling threads and/or auxiliary threads. There is further provided a deflection element operatively associated with the knitting needle for the introduction of filling threads or auxiliary threads, respectively, into the knitting region or zone of a hook of the knitting needle. The deflection element is driven so as to move back-and-forth and by means of an actuation element driven in cycle with the machine can be brought, transversely to its direction of movement, from a rest position into a knitting position where the deflection element deflects filling thread or auxiliary thread, respectively, to the knitting region of the knitting needle hook.

8 Claims, 2 Drawing Figures

SHUTTLELESS WEAVING MACHINE, ESPECIALLY RIBBON LOOM

BACKGROUND OF THE INVENTION

The present invention relates to a new and improved construction of a shuttleless weaving machine, especially a ribbon loom, comprising at least one weft thread-or filling thread-insertion element and at least one to-and-fro driven knitting needle or equivalent structure movable back-and-forth along the selvage or edge of the woven cloth or ribbon opposite the filling thread-insertion element for the formation of a knitted edge by tying the inserted filling threads and/or auxiliary threads, and further comprises a deflection element associated with the knitting needle for the introduction or insertion of filling threads or auxiliary threads into the knitting region or zone of a hook of the knitting needle.

In the case of shuttleless ribbon looms it is already well known to those skilled in the art that the weft or filling thread loop inserted into the open shed by the filling thread-insertion element must be fixed at the opposite side of the insertion element.

During fixing of the inserted filling thread with the aid of a knitting needle there can be formed a knitted edge or selvage with or without the assistance of an auxiliary thread.

If there is dispensed with the use of an auxiliary thread, then, the filling threads are tied to one another with the aid of the knitting needle, and in each instance the filling thread which has been picked or inserted must be engaged by the knitting needle.

When using an auxiliary thread the momentarily inserted or shot-in filling thread either can be tied or secured by itself with the auxiliary thread or together therewith in one working step.

During typing of the filling thread alone to the auxiliary thread the knitting needle must engage the auxiliary thread and the filling thread should not be engaged by the knitting needle.

On the other hand, if the auxiliary thread and the filling thread are conjointly or collectively tied, then, the knitting needle must engage both the auxiliary thread and the filling thread.

Depending upon the tying operation either the filling or weft thread and/or the auxiliary thread must be brought into the operable zone or region of the knitting needle hook.

It is, for instance, known to the art from Swiss Patent 545,872 to employ an insertion lever for the insertion or introduction of the thread which is to be hooked into the knitting needle hook. This equipment is, however, associated with the drawback that the insertion lever only can be arranged at the outermost fabric edge or selvage and externally of the operable region of the reed, so that it is not engaged by the reed.

SUMMARY OF THE INVENTION

Hence, it is a primary object of the present invention to provide an improved apparatus of the previously mentioned character which is not associated with the aforementioned drawbacks and limitations of the prior art constructions.

A further object of the present invention aims at the provision of a new and improved construction of shuttleless weaving machine, especially a ribbon loom or the like, which is relatively simple in construction, extremely reliable in operation, not readily subject to breakdown or malfunction, requires a minimum of servicing and maintenance, and is not associated with the aforementioned limitations of the prior art looms.

Now in order to implement these and still further objects of the invention, which will become more readily apparent as the description proceeds, the weaving machine of the previously mentioned type is manifested by the features that the deflection element is driven back-and-forth or to-and-fro in synchronism with the associated knitting needle and by means of an actuation element driven in cycle with the operation of the machine can be brought, transversely with respect to its direction of movement, from a rest position into an operable position where the deflection element deflects or displaces filling threads or auxiliary threads, respectively, into the effective zone or knitting region of the knitting needle hook.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various embodiments the same reference characters have been generally used for the same components and wherein.

DETAILED DESCRIPTION OF THE INVENTION

Figure 1:
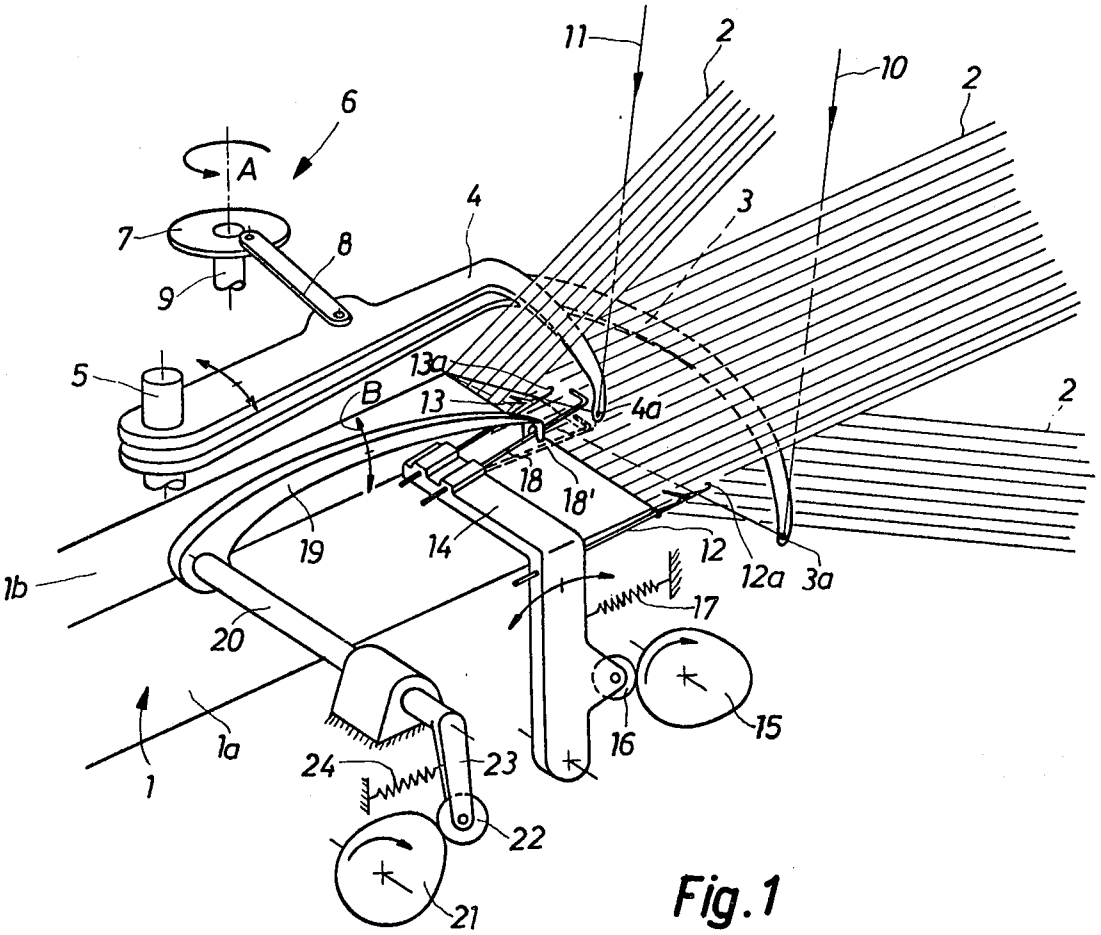
FIG. 1 schematically illustrates a first exemplary embodiment of a ribbon loom comprising a deflection element acting upon the weft of filling threads.

Describing now the drawings, it is to be understood that only enough of the construction of the weaving machine has been illustrated in order to enable those skilled in the art to readily understand the basic concepts of the present invention. With the exemplary embodiment of ribbon loom illustrated solely by way of example and not limitation in the drawings, the conventional components of the loom proper which are not necessary to the understanding of the basic concepts of the invention have been omitted to preserve clarity in illustration.

Turning attention therefore to FIG. 1, there is schematically illustrated therein by way of example a ribbon loom for the fabrication of a double shed fabric or cloth, wherein, for the formation of the knitted edge or selvage in each instance filling or weft threads are tied with filling threads. In this figure the woven ribbon or tape is designated by reference character 1 and the warp threads are designated by reference character 2. The ribbon 1 formed as a double shed fabric possesses two superimposed fabric portions 1*a* and 1*b* of different width. Furthermore, there are provided two filling thread-insertion elements or members 3 and 4, each of which have been illustrated engaging into a respective shed formed by the warp threads 2. Both of the weft or filling thread-insertion elements 3 and 4 are secured to a common shaft 5 and driven to oscillate back-and-forth or to-and-fro by means of a suitable drive 6 in the plane of the woven fabric, here the ribbon 1. The drive 6 is constructed, for instance, as a crank drive possessing a lever or link 8 eccentrically mounted on a rotatable disk or plate 7 and engaging with the filling thread-insertion element 4. The disk 7 is secured to a driven rotatable shaft 9 and is thus driven in the direction of the arrow A. Each filling thread-insertion element 3 and 4 possesses an eyelet or eye 3*a* and 4*a*, respectively, through which there is guided a filling or thread 10 and 11 respectively.

At the side of each fabric portion 1*a* and 1*b* which is opposite the filling thread-insertion element 3 and 4 there is arranged a knitting needle 12 and 13, respectively, or equivalent structure. Both knitting needles 12 and 13 are attached to an oscillating lever 14 which is moved to-and-fro by means of a rotatably driven control disk or cam 15 coacting with a roller or cam follower 16 or equivalent structure secured in any suitable fashion to the oscillating lever 14 or the like. By means of a tension spring 17 or equivalent structure the roller or cam follower 16 is continually biased or urged against the surface of the control disk or control cam 15. The knitting needles 12 and 13 carry out a to-and-fro or back-and-forth movement along the edges of both fabric portions 1*a* and 1*b*.

Adjacent the knitting needle 13 there is secured on the oscillating or rocker lever 14 a movable support means defining a deflection element or member 18. Cooperating with such deflection element 18 is an actuation lever or element 19 which is secured to a shaft 20 and can be moved up and down in the direction of the double-headed arrow B. In order to rotate the shaft 20 there is provided a revolving control cam or disk 21 which cooperates with a roller or cam follower 22 which is arranged at an arm 23 attached to the shaft 20. A tension spring 24 or the like engages the arm 23 in order to bias the roller 22 against the control cam 21.

During its downward movement the actuation lever 19 presses against the elastically or resiliently deflectable deflection element 18 and moves such from its rest position into its operative or knitting position. The deflection element 18 located in its so-called knitting position has been illustrated in broken or phantom lines and designated by reference character 18′. In the operative or knitting position (indicated by reference character 18′) the deflection element 18 deflects or shifts the filling thread 11 into the operable region or knitting zone of the hook 13*a* of the knitting needle 13.

As soon as the actuation lever 19 again rocks or swings upwards the deflection element 18, owing to its resilient restoring characteristics automatically moves back into its rest position.

After the insertion of the filling or weft thread 11 the oscillating or rocker lever 14 and together therewith the knitting needle 13 and the deflection element 18 are moved towards the open shed. The actuation lever 19 is lowered and presses the deflection element 18 into its knitting position 18′. During the return movement of the filling thread-insertion element 4 out of the shed the filling thread 11 remains wrapped about the knitting needle 13. Now the actuation lever 19 is raised and the deflection element 18 resiliently springs back into its rest position. With the thereafter following retraction movement of the knitting needle 13 and the deflection element 18 the filling weft thread 11 is tied in a conventional manner with the previously inserted weft thread loop.

The formation of the knitted edge at the outermost ribbon edge or selvage occurs in a corresponding manner, and the inserted filling or weft thread 10 is directly engaged or seized by the knitting needle 12 without the aid of a deflection element or device.

Figure 2:
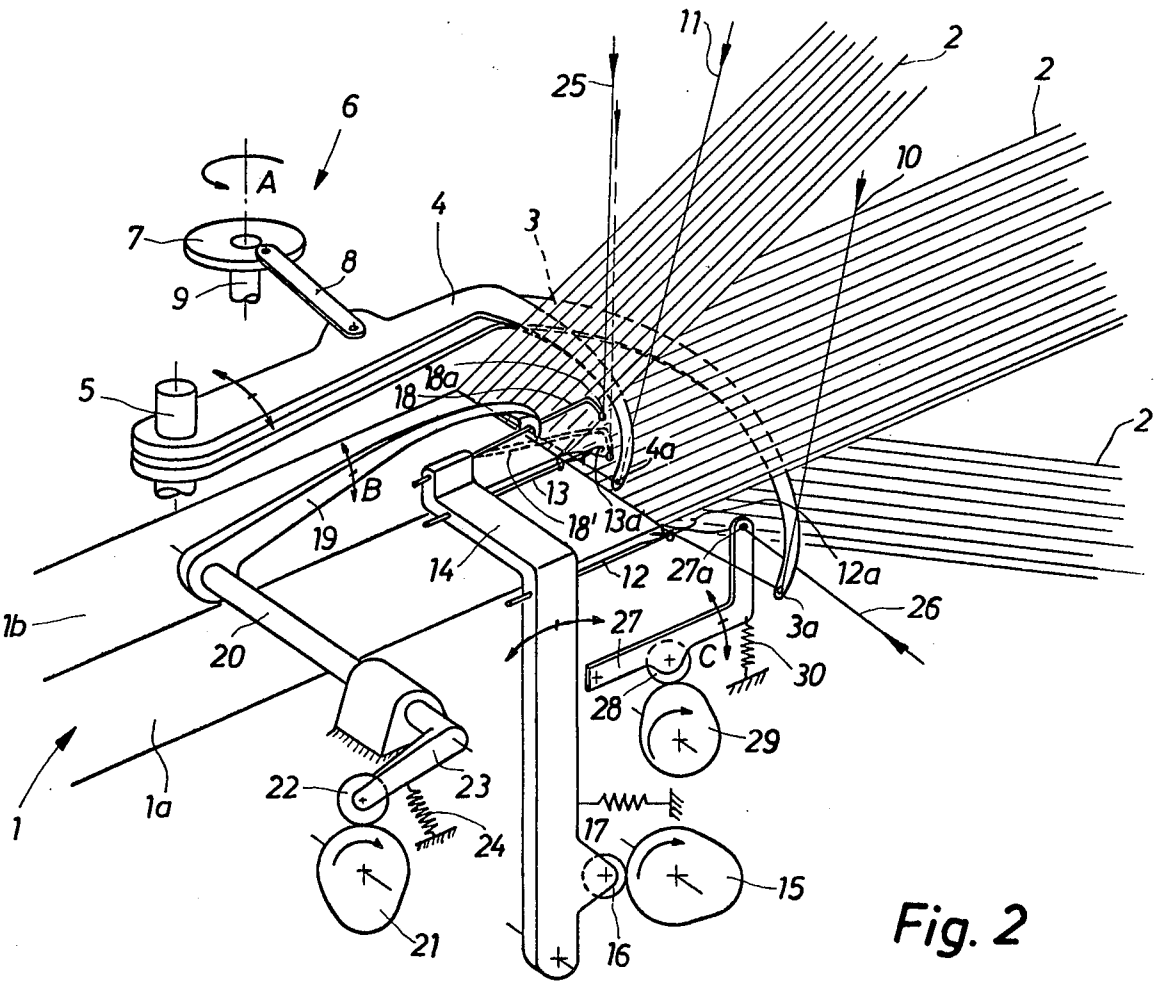
FIG. 2 illustrates a second exemplary embodiment of a ribbon loom comprising a deflection element acting upon the auxiliary threads.

With the exemplary embodiment of loom illustrated in FIG. 2 the formation of the knitted edge occurs with the aid of an auxiliary thread, and the filling or weft thread is tied together with such auxiliary thread or the weft thread and auxiliary thread are tied together in one working step or operation.

The ribbon loom or weaving machine illustrated in FIG. 2 essentially corresponds to the loom of FIG. 1. Hence, corresponding components have been conveniently designated by the same reference characters in both FIGS. 1 and 2.

The elastically or resiliently deflectable or displaceable deflection element 18 possesses an eyelet or eye 18*a* through which there is threaded or guided an auxiliary thread 25. At the outer ribbon or band edge of the fabric portion 1*a* there is guided an auxiliary thread 26 through an eyelet or eye 27*a* of a substantially L-shaped insertion lever 27. This insertion lever or lever member 27 carries a roller or cam follower 28 which bears upon a rotatably driven control cam or disk 29. In order to insure for continuous bearing contact of the roller 28 at the control cam or disk 29 there is provided a tension spring 30 or equivalent structure which engages with the insertion lever 27. By means of the control cam or disk 29 the insertion lever 27 is moved up and down in the direction of the double-headed arrow C.

The insertion lever 27, when in its upper terminal or end position, extends by means of the lever portion possessing the eyelet or eye 27*a* into the region or zone formed by the inserted filling thread 10, the filling thread-insertion element 3 and the ribbon edge or selvage. In this upper terminal position the auxiliary thread 26 is inserted into the hook 12*a* of the weaving needle 12, and there takes place the formation of a knitted edge or selvage by carrying out a tying operation in a conventional manner with the aid of auxiliary thread 26.

At the inner ribbon edge of the fabric portion 1*b* the knitted edge is formed as follows:

If the filling thread 11 is to be tied to the auxiliary thread 25, then after the insertion of the filling thread 11, the deflection element 18 and the knitting needle 13 are conjointly displaced towards the open shed, the knitting needle 13 moving therethrough below the filling or weft thread 11. As soon as the knitting needle 13 is located beneath the filling thread 11 the deflection element 18 is deflected downwardly with the aid of the actuation lever 19. Hence, with the knitting needle 13 downwardly inclined and a certain spacing between the needle end and the eyelet 18*a* of the deflection element 18 the auxiliary thread 25 wraps around the knitting needle 13. During further advancement of the knitting needle 13 the auxiliary thread 25 is secured between the tongue and hook of the knitting needle. The actuation lever 18 automatically returns back into its rest position. During the subsequent retraction of the knitting needle 13 and the deflection element 18 there occurs the desired tying of the filling thread 11 to the auxiliary thread 25. If, in the case of the ribbon loom illustrated in FIG. 2, the filling or weft thread 11 and the auxiliary thread 25 are to be tied together in one operation for forming the inner knitted edge or selvage, then during the forward displacement or advancement of the deflection element 18 and the knitting needle 13 the latter is pushed over the filling thread 11. By depressing the deflection element 18 by means of the actuation lever 19 the auxiliary thread 25 is inserted into the hook 13*a* of the weaving needle 13. As soon as the deflection element 18 is again located in its rest position, then, the deflection element 18 and the knitting needle 13 are again moved back, so that in known manner the auxiliary thread 25 and filling thread 11 are tied together.

With the illustrated exemplary embodiments, the deflection element, owing to its resilient-plastic properties, automatically returns or moves back into its rest position. However, it is also conceivable to use a deflection element which does not have any resilient or spring-like characteristics, in which case then there must be provided suitable means for returning the deflection element back into its rest position. For instance, the actuation lever also could be used for such retraction of the deflection element or member back into the rest position.

Due to the described construction of the deflection element coacting with an actuation lever it is possible to also arrange this deflection element at an inner ribbon edge without it being contacted by the reed. As mentioned, this is achieved in that the deflection element together with the knitting needle is moved out of the effective region or operable zone of the reed.

It is, of course, also possible to provide the disclosed deflection element together with the actuation lever at the outermost ribbon edge. In most instance it will be however, advantageous to use at the outermost ribbon edge a conventional thread insertion device, which, for instance, can possess a construction of the type shown in FIG. 2 or in Swiss Patent 545,872, the disclosure of which is incorporated herein by reference.

While there is shown and described present preferred embodiments of the invention, it is to be distinctly understood that the invention is not limited thereto, but may be otherwise variously embodied and practiced within the scope of the following claims.

What is claimed is:

1. A shuttleless weaving machine for weaving a fabric ribbon from weft threads and auxiliary threads, comprising at least one weft insertion element, at least one selvedge knitting needle having a hook, means for driving said selvedge knitting needle to-and-fro along a knitted selvedge edge of the fabric ribbon which is located opposite the weft insertion element for the formation of the knitted selvedge edge by knitting the inserted weft thread to the previously inserted weft thread or the auxiliary thread, a pivotable deflection element operatively associated with the selvedge knitting needle for controlled deflection of the weft thread or the weft thread and the auxiliary thread, into a knitting zone of the hook of the selvedge knitting needle, means for to-and-fro motion of the deflection element, an actuation element, means for driving the actuation element in cycle with the operation of said knitting needle and said deflection element so as to engage said deflection element for displacement thereof transversely with respect to the latter's direction of movement from a rest position into an operative position for acting on one of said threads or to deflect the latter into the knitting zone of the knitting needle hook.

2. The weaving machine as defined in claim 1 further comprising common support means for said knitting needle and said deflection element to be secured to, said driving means for said knitting needle including means for driving said common support means back-and-forth.

3. The weaving machine as defined in claim 1, wherein the actuation element comprises a lever driveable back-and-forth transversely with respect to the direction of movement of the deflection element.

4. The weaving machine as defined in claim 1, wherein the deflection element is formed of an elastically resilient material automatically springing into its rest position upon an applied force being withdrawn thereform.

5. The weaving machine as defined in claim 1, wherein the deflection element includes an eyelet for guidance of the auxiliary thread.

6. The weaving machine as defined in claim 1, wherein the drive means for said knitting needle and said means for moving said deflection element comprises common drive means.

7. A shuttless weaving machine for weaving a fabric ribbon from weft threads and auxiliary threads comprising at least one weft insertion element, at least one selvedge knitting needle having a hook, means for driving said selvedge knitting needle to-and-fro along a knitted selvedge edge of the fabric ribbon which is located opposite the weft insertion element for the formation of the knitted selvedge edge by knitting the inserted weft thread to the previously inserted weft thread or the auxiliary thread, a pivotable deflection element operatively associated with the selvedge knitting needle for controlled deflection of the weft thread or the weft thread and the auxiliary thread into a knitting zone of the hook of the selvedge knitting needle, a displaceable deflection element, an actuation element, means for driving the actuation element for the latter to engage and displace the deflection element transversely with respect to the latter's direction of movement from a rest position into an operative position for acting on one of said threads to deflect the latter into the knitting zone of the knitting needle hook.

8. A shuttleless weaving machine for weaving a fabric ribbon from weft threads, comprising at least one weft insertion element, at least one selvedge knitting needle having a hook, means for driving said selvedge knitting needle to-and-fro along a knitted selvedge edge of the fabric ribbon which is located opposite the weft insertion element for the formation of the knitted selvedge edge by knitting the inserted weft thread to the previously inserted weft thread, a pivotable deflection element operatively associated with the selvedge knitting needle for controlled deflection of the weft thread into a knitting zone of the hook of the selvedge knitting needle, means for to-and-fro motion of the deflection element, an actuation element, means for driving the actuation element in a cycle with the operation of said knitting needle and said deflection element for said actuation element to engage said deflection element for displacement thereof transversely with respect to the latter's direction of movement from a rest position into an operative position for acting on said weft thread to deflect the latter into the knitting zone of the knitting needle hook.

* * * * *